US006595365B1

(12) United States Patent
Wigmore

(10) Patent No.: US 6,595,365 B1
(45) Date of Patent: Jul. 22, 2003

(54) PILLBOX FOR THE PHYSICALLY IMPAIRED

(76) Inventor: Mary Wigmore, 18 E. Cohawkin Rd., Clarksboro, NJ (US) 08020

( * ) Notice: Subject to any disclaimer, the term of this patent is extended or adjusted under 35 U.S.C. 154(b) by 18 days.

(21) Appl. No.: 10/006,437

(22) Filed: Nov. 23, 2001

(51) Int. Cl.[7] ..... B65D 83/04

(52) U.S. Cl. ..... 206/538; 206/204; 206/540

(58) Field of Search ..... 206/204, 528, 206/530, 538, 539, 540, 486, 488, 489; 220/212, 315, 507, 521, 522, 810

(56) References Cited

U.S. PATENT DOCUMENTS

| | | | | | |
|---|---|---|---|---|---|
| 3,367,484 | A | * | 2/1968 | Nelson | 206/540 |
| 3,782,584 | A | | 1/1974 | Swenson | |
| 3,826,358 | A | * | 7/1974 | Butler et al. | 206/204 |
| 4,084,695 | A | | 4/1978 | Halbich | |
| 4,126,224 | A | | 11/1978 | Laauwe | |
| 4,372,445 | A | | 2/1983 | Keffeler | |
| 4,403,462 | A | | 9/1983 | Halbich | |
| 4,475,654 | A | | 10/1984 | Fruchter | |
| 4,593,819 | A | * | 6/1986 | Will | 206/538 |
| 4,640,560 | A | | 2/1987 | Blum | |
| 4,793,492 | A | | 12/1988 | Halbich | |
| 4,911,327 | A | | 3/1990 | Shepherd | |
| 5,011,032 | A | | 4/1991 | Rollman | |
| 5,344,024 | A | | 9/1994 | Cohu | |
| 5,351,818 | A | | 10/1994 | Daneshvar | |
| 5,718,347 | A | | 2/1998 | Walker | |
| 5,806,670 | A | | 9/1998 | Harlan | |
| 5,915,558 | A | * | 6/1999 | Girvetz | 206/534 |
| 6,041,932 | A | | 3/2000 | Holmberg | |
| 6,221,027 | B1 | * | 4/2001 | Pitesky | 206/538 |

* cited by examiner

*Primary Examiner*—Luan K. Bui
(74) *Attorney, Agent, or Firm*—John H. Scarborough; Robert R. Mallinckrodt

(57) ABSTRACT

A pillbox for holding medications to be dispensed having top lid and lower section; and having removable cups arranged in rows for holding the medications. The removable cups are constructed with thick lips on the top to facilitate handling. The lid has an undercover which snaps onto the lid to form a compartment, and the undercover has openings to facilitate air circulation within the pillbox. A desiccant can be inserted into the compartment for keeping the medications dry. The interior of the lower section of the pillbox can be molded to receive and hold the removable cups or be mounted with a platform to receive and hold the removable cups. The bottom outside of the pillbox is mounted with rubber feet to keep the pillbox from sliding while being used.

18 Claims, 17 Drawing Sheets

PILLBOX FOR THE PHYSICALLY IMPAIRED

BACKGROUND OF THE INVENTION

1. Field of the Invention

This invention is in the field of containers for holding dosages of medications. More particularly, the present invention is for storing medications in the form of pills, tablets, and powders, in a container adapted to be used by physically impaired persons.

2. General Background

There are many products on the market which hold medications for dispensing. However, they are difficult to open and do not provide easy access to medications. These products do not have containers which are large enough to contain the medications a seriously ill patient might require. This affects moderately disabled persons, as well as the elderly and seriously physically impaired people. And, these products slip and slide on a flat, smooth surface making it difficult for an impaired person to handle. Nor do these products have a means to protect the medications from moisture.

3. Discussion of the Prior Art

Cohu, U.S. Pat. No. 5,344,024, provides a case for storing, organizing and sorting small articles. It has removable containers, means for sealing tops when the case is closed, and means for preventing movement of the containers when the case is closed.

Shepherd, et al., U.S. Pat. No. 4,911,327, discloses a medications dispenser for providing scheduled dosages. The release of pills is controlled by a predetermined medication program. On release of the dosages, an alarm, both visual and audible, is activated.

Daneshvar, U.S. Pat. No. 5,351,818, discloses a medications container for storing pill bottles. The container contains a week's supply of pills in daily compartments. It also has a ledge on which a weekly pill container rests.

Halbich, U.S. Pat. No. 4,403,462, provides a medications dispensing container for pills having individual compartments formed by partitions. Each compartment is closed by an individual tab.

Halbich, U.S. Pat. No. 4,084,695, also discloses a medications container for pills having individual compartments. Each compartment is covered by a individual sealing tab which can be easily broken. The compartments are designed to be pre-loaded.

Keffeler, U.S. Pat. No. 4,372,445, provides a medications container having a plurality of open topped compartments closed by a cover assembly each cover includes an integral fracturable tab.

Laauwe, et al., U.S. Pat. No. 4,126,224, is a moisture-proof, child-resistant pill box. The pillbox has a sliding cover and elastically compressible gasket. By combination of squeezing and of sliding the cover, one can gain entrance to the inside of the box to retrieve medications.

Halbich, U.S. Pat. No. 4,793,492, provides a pillbox having a plurality of compartments for pills arranged and indexed in units, each individual unit able to be opened separately. In the disclosed embodiment, the compartments are arranged by days of the week, each unit having latch tops, and the container lies flat.

Blum, U.S. Pat. No. 4,640,560, discloses a dispenser for medications pre-stored for a week. The dispenser has compartments arranged in rows and columns each compartment having an individual pillbox slidable received within each compartment. Further, it has an indicator means associated with each pillbox which when associated with a clock indicates when the contents of each pillbox is to be dispensed.

Holmberg, U.S. Pat. No. 6,041,932, discloses a system for organizing and storing medications in a predetermined therapeutic regime having compartments for containing individual packets of medications. The container is arranged in four rows of seven containers.

Walker, U.S. Pat. No. 5,718,347, provides a container for medications having a child resistant closure mechanism. A latch is located within a recess on the sidewall of the container, a cavity formed between the sidewall and the latch recess. The latch must be depressed by the user, and the remainder of the latch is released by pressing on a region of the sidewall of the container.

Swenson, U.S. Pat. No. 3,782,584, is a pillbox which is opened by squeezing the cover thereof while sliding the cover laterally to open the pillbox.

Harlan, U.S. Pat. No. 5,806,670, discloses a portable pillbox with two rounded compartments having subcompartments therein. Each compartment can be closed by a lid which snaps thereon, and each compartment able to be removed from the pillbox.

However, none of the prior art provides a means for a pillbox which has moisture absorbing capabilities, has removable cups which are easy to hold, or has a means for preventing a pillbox from slipping and sliding.

SUMMARY OF THE INVENTION

The main features of the Pillbox are moisture absorbing desiccant pads, thick lips of the removable cups, and rubber feet mounted on the base of the box.

The instant invention provides a pillbox which contains removable cups which are large enough to contain multiple medications. These cups are designed to have thick lips to make the cups easier to grasp and hold. The thick lips are designed such that when the lid is closed it forms a top over the cups. The medications will not fall out of the cups, but such top is not air-tight so as to restrict air circulation in and between the cups. The removable cups can be removed from the pillbox so a user can take the medication directly from the cups without having to put the medication in one's hand or in another container.

The pillbox is designed to contain a desiccant so that the medications do not absorb moisture. Moisture absorbing desiccant pads within the lid are designed to absorb moisture within the pillbox so that the pills will not disintegrate from moisture and that powders will not harden from absorption of moisture. Moisture absorbing desiccant pads, such as silica gel packets, perform the same moisture removing capability that is performed by silica gel packets that are packaged commercially with electrical and electronic components. These moisture absorbing desiccant pads help to maintain the efficacy of the pills and powders while they are stored in the pillbox.

The rubber feet on the bottom of the pillbox provide a means of stabilizing the pillbox on a flat horizontal surface so as to prevent the pillbox from being accidentally overturned or knocked to the floor.

The pillbox interior provides a secure place for each removable cup to reside and is preformed to inhibit movement of the cups within the pillbox. The easy-to-use flip-up locking device prevents the lid from accidentally opening should the pillbox be jostled around or dropped.

This pillbox would be very useful for any user that takes multiple medications on a daily basis and provides enough medication storage space for four doses of medication per day for a designated number of days, such as seven days. Should the user go on vacation or extended travel, the pillbox can be easily stored in one's luggage, briefcase, or purse.

The Pillbox is preferably constructed of plastic. The plastic may be constructed of a clear or a light translucent color. The pillbox may also be constructed of amber-tinted plastic so as to shield the contained medications from ultraviolet rays that can reduce the strength of medications.

Whereas all previously mentioned prior art provide containers for dispensing medications, this invention provides for moisture absorbing capabilities, removable cups containing medications which are easy hold, and rubber feet mounted on the base of the pillbox.

BRIEF DESCRIPTION OF THE DRAWINGS

The best mode presently contemplated for carrying out the invention in actual practice is shown in the accompanying drawings, in which.

DETAILED DESCRIPTION OF THE ILLUSTRATED EMBODIMENT

Figure 1:
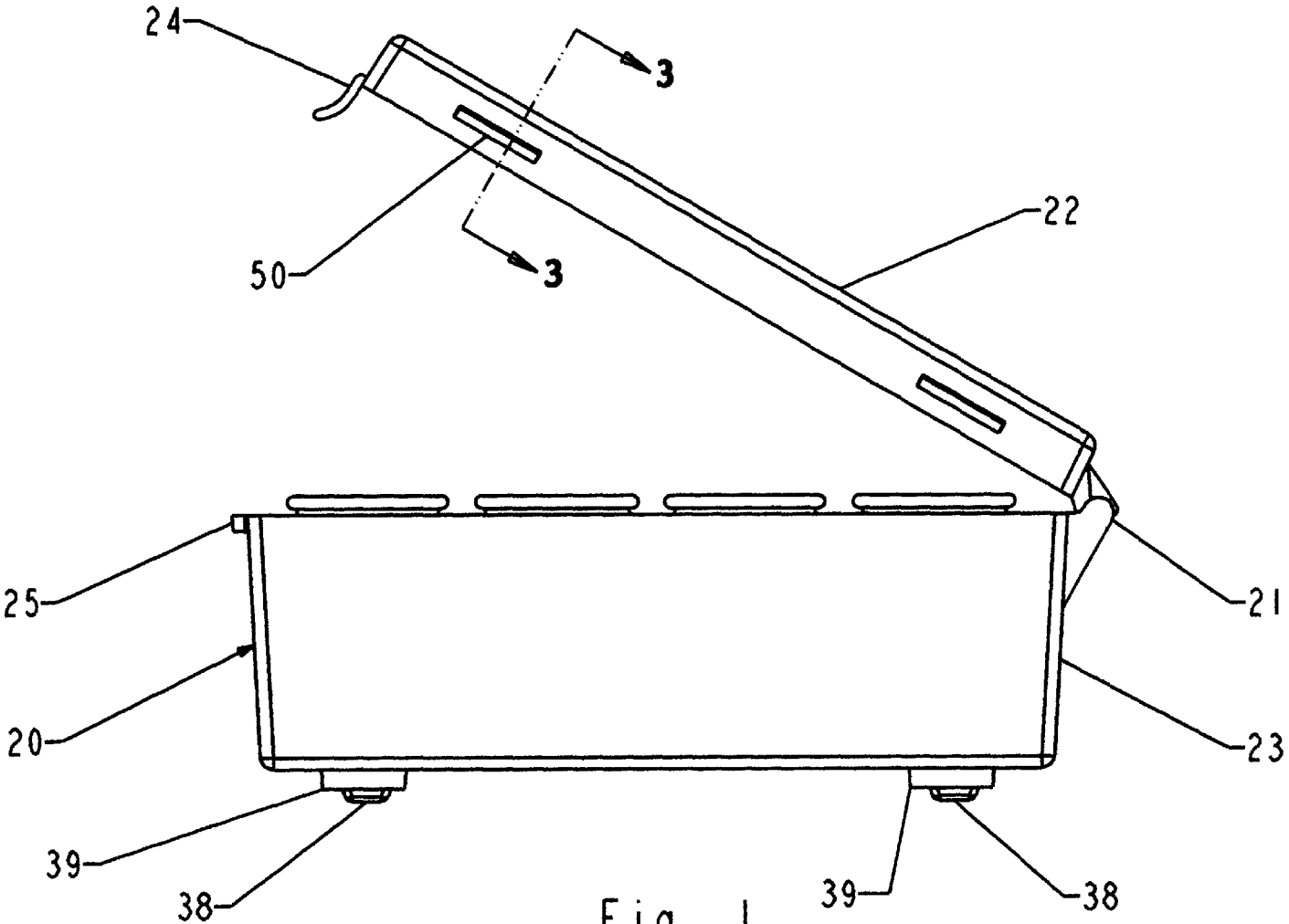
FIG. 1 is a side elevation of the pillbox showing the lid partially open.
Figure 2:
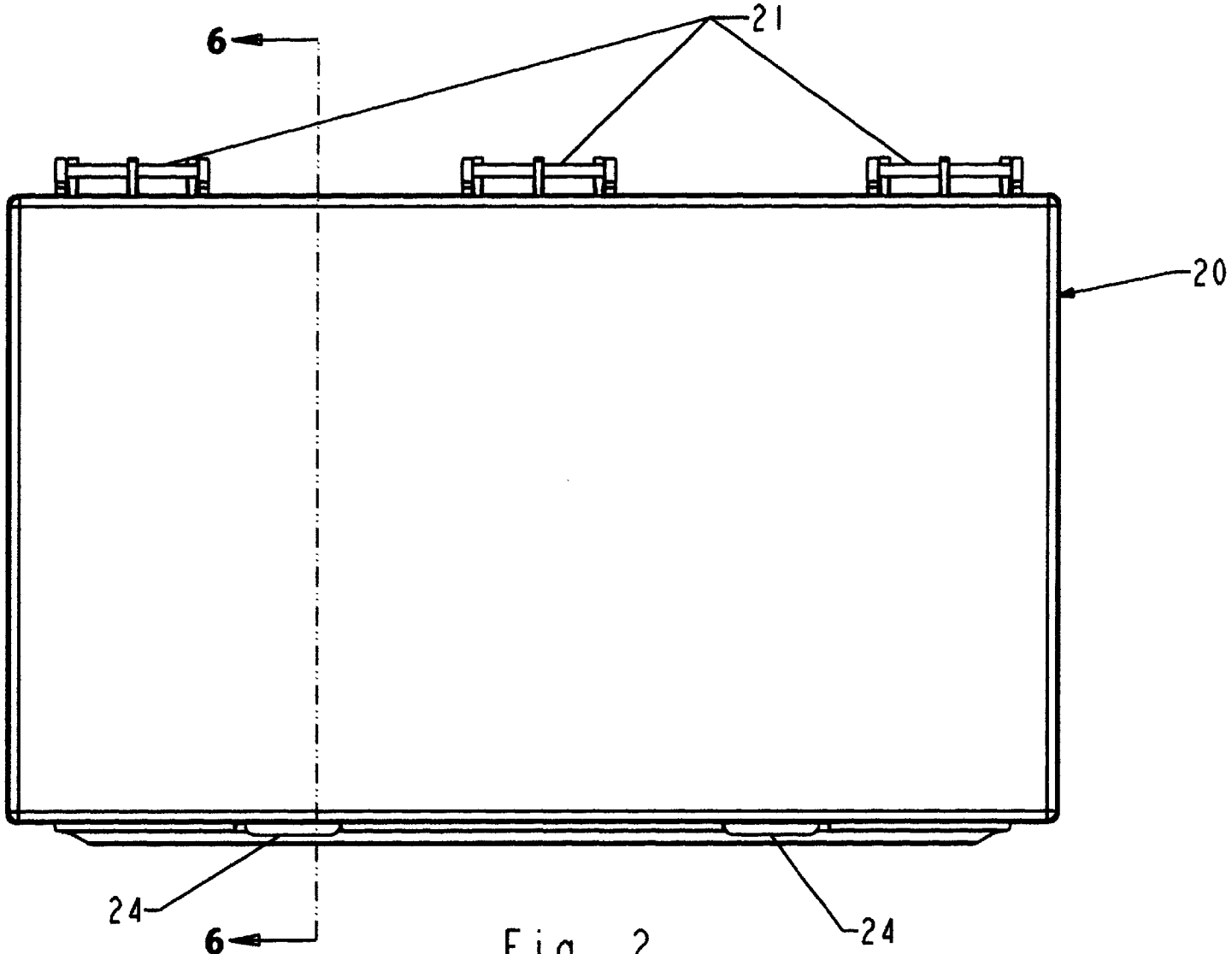
FIG. 2 is a top plan view of the pillbox, generally, with the lid closed, for showing a first embodiment of the lower interior.
Figure 8:
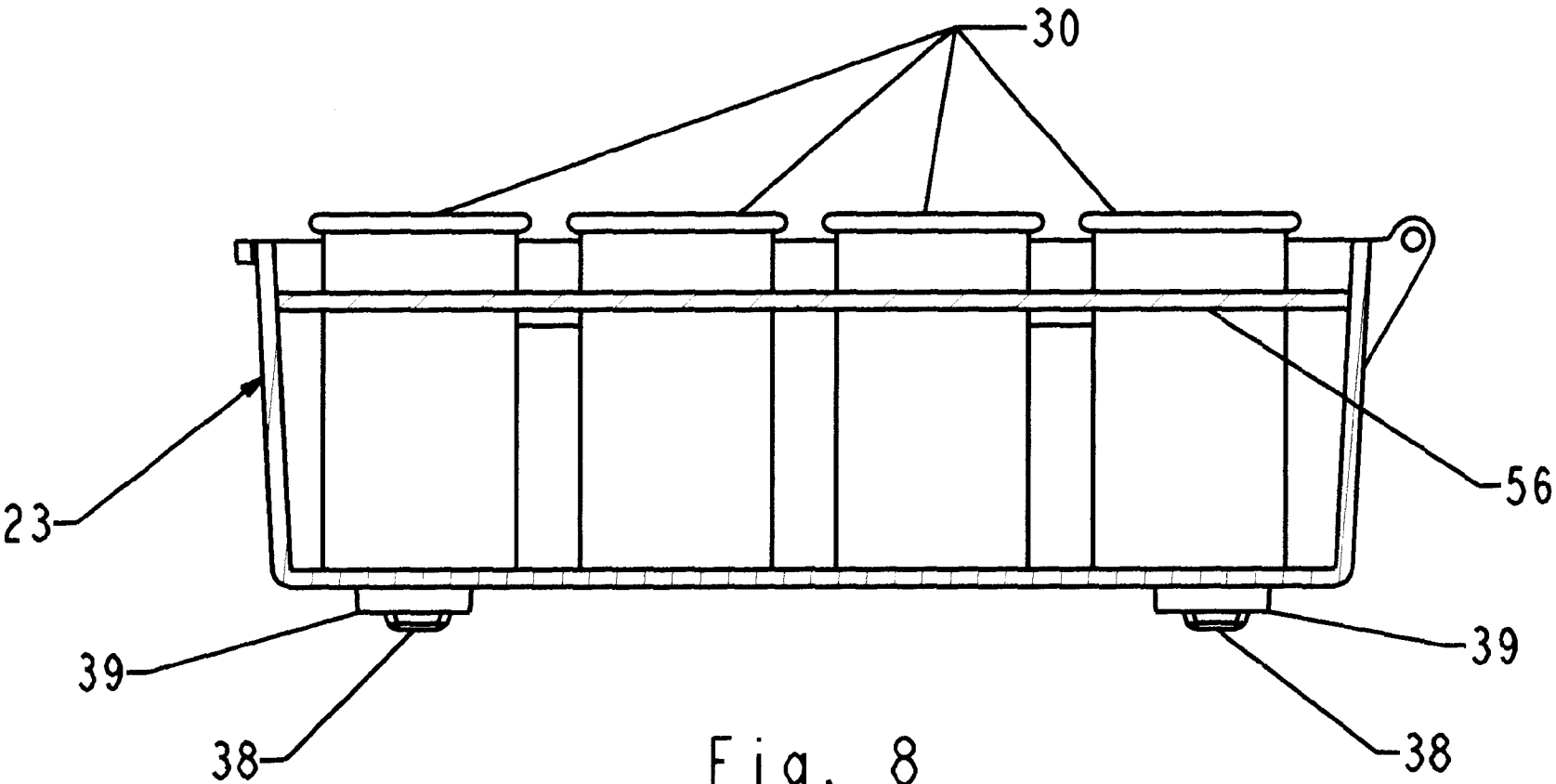
FIG. 8 is a section showing the first embodiment of the interior of the lower section of the pillbox taken along 8—8 of FIG. 7 further showing a row of removable cups.

In the illustrated embodiment, the pillbox 20, FIG. 1, is a box that is designed to hold medications. The dimensions of the preferred embodiment are 12½"×8½"×2¼", approximately. The pillbox 20 has a lid 22 and a lower section 23 which are connected by a living hinge 21, FIG. 1. The living hinge 21 allows the lid 22 and lower section 23 to be snapped together, FIGS. 1 and 2. The pillbox 20 is closed and secured by latches 24 on lid 22 and catches 25 on the front of the pillbox 20, FIGS. 1 and 2. The base of the pillbox 20 has rubber feet 38, FIG. 1, extending therefrom so that the pillbox 20 can remain secure on a smooth flat surface. The rubber feet 20 are mounted on foot supports 39, FIGS. 1, 6, and 8, with pressure sensitive adhesive material. Foot supports 39 are molded as part of the bottom of the pillbox 20, as shown on FIGS. 1, 6, and 8. Or, the rubber feet can also be attached directly to the bottom of the pillbox without foot supports, not shown. Rubber feet are generally commercially available with pressure sensitive adhesive material to allow them to be attached permanently to a surface and are well known in the art.

Figure 3:
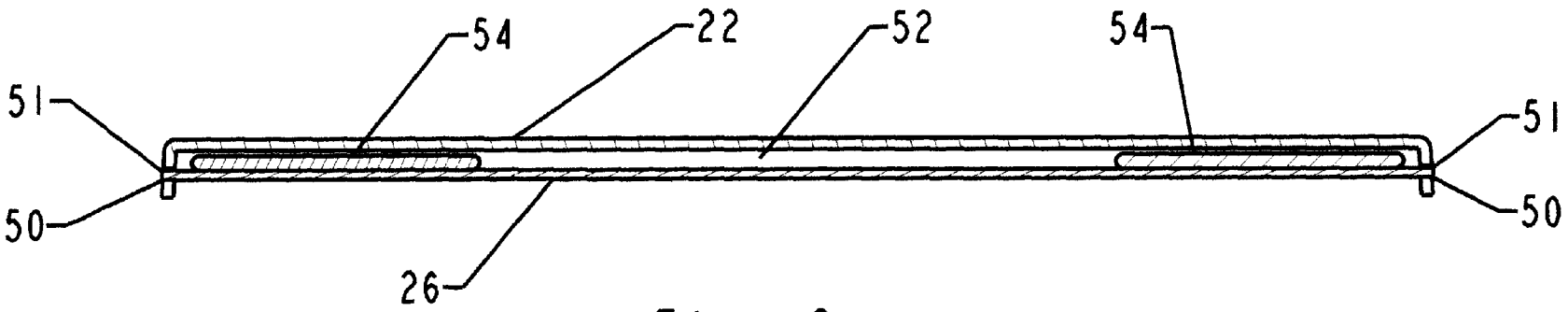
FIG. 3 is a section taken along 3—3 of FIG. 1 showing the lid with the undercover in place, shown separate from the pillbox.
Figure 4:
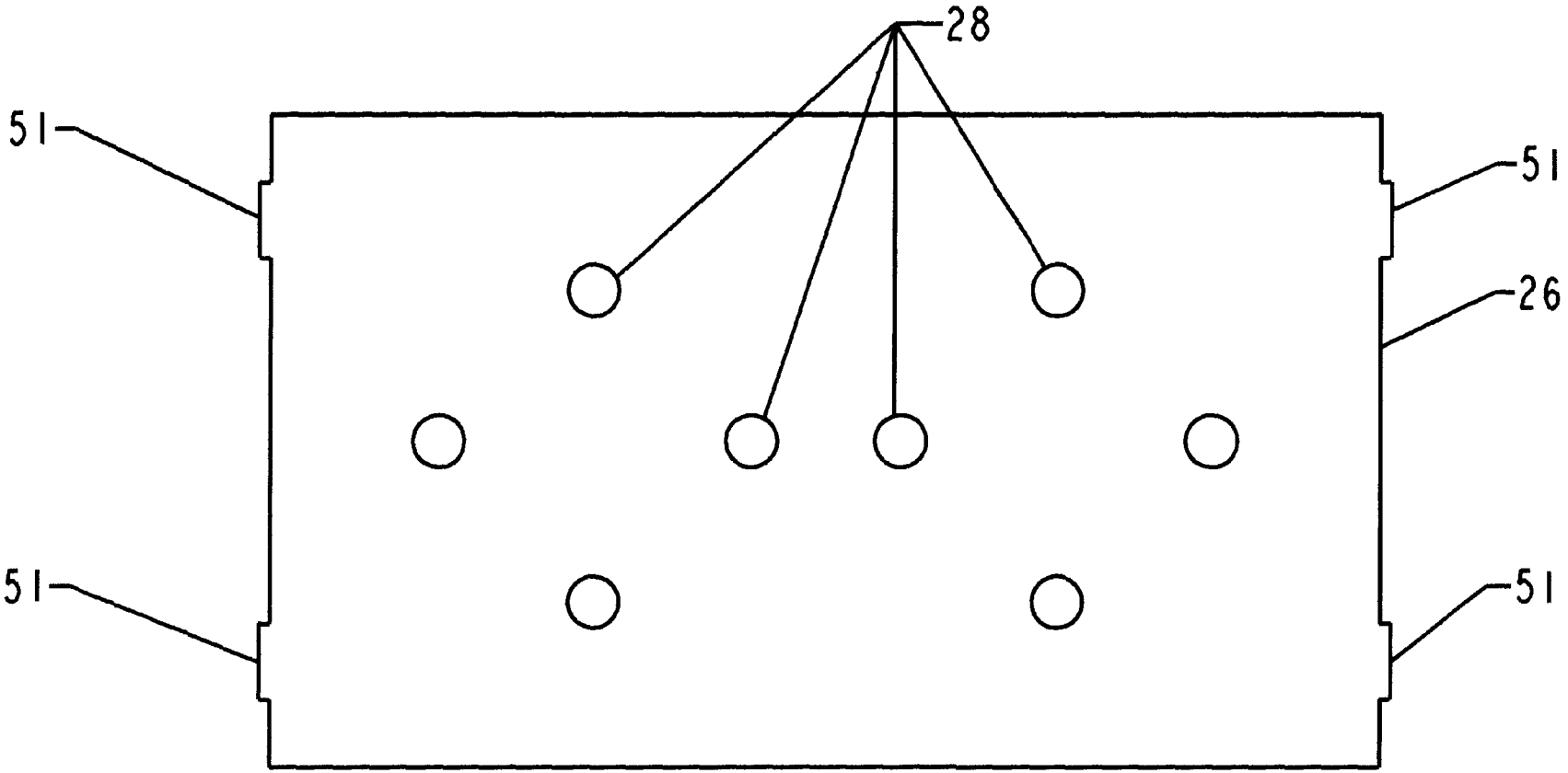
FIG. 4 is a bottom plan view of the undercover of the lid.
Figure 5:
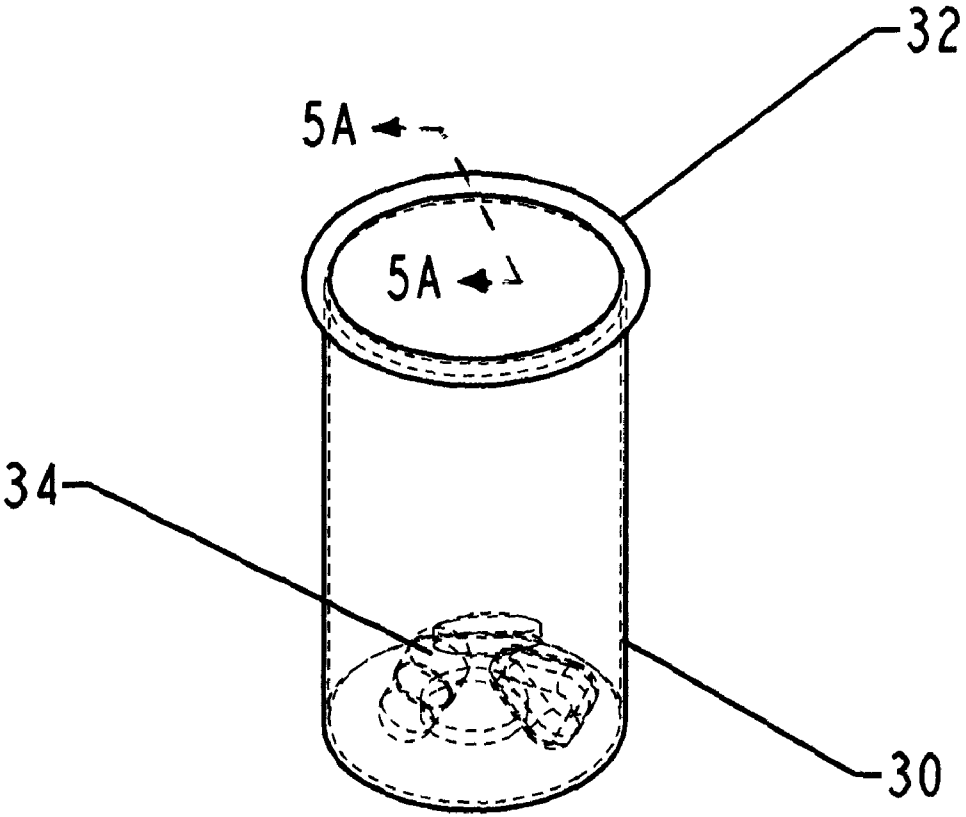
FIG. 5 is a perspective view of a removable cup.
Figure 6:
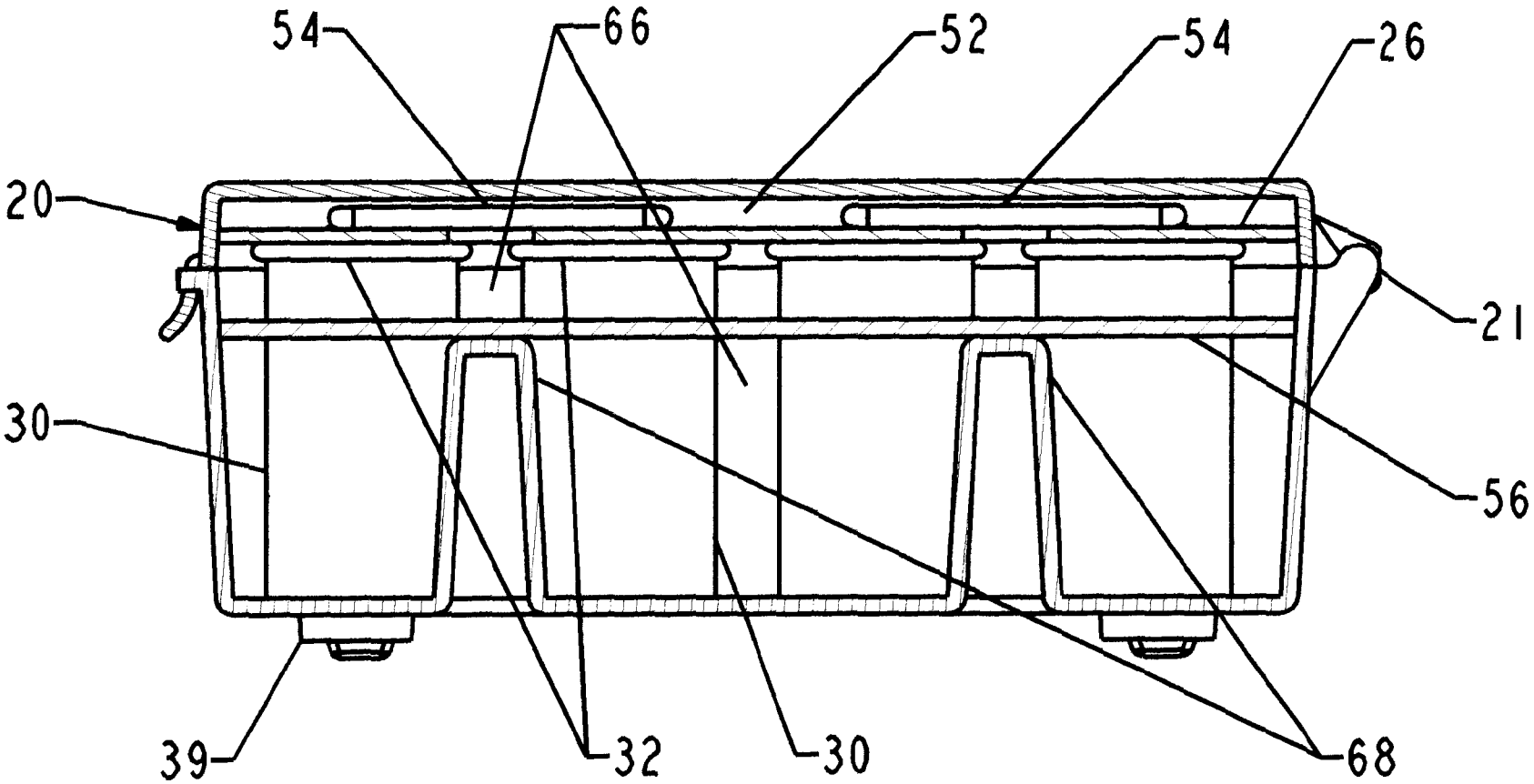
FIG. 6 is a section showing the first embodiment of the lower section of the pillbox with the lid closed taken along 6—6 of FIG. 2, further showing a row of removable cups.

The box lid 22 is constructed to hold moisture absorbing desiccant pads 54, FIGS. 3 and 6. An undercover 26 is designed to snap into place into notches 50 located on the sides of the lid 22, as shown in FIGS. 1, 3, and 4, to form a space 52 for holding the desiccant pads 54, FIGS. 3 and 6. The undercover 26 is preferably a tough durable plastic material having tabs 51 on the ends thereof, as shown in FIGS. 3 and 4. The undercover 26 is flexible such that the tabs 51 can snap into place into the notches 50 of the lid 22, FIG. 3. The undercover 26 of the lid 22 is adapted to be removed, for the purpose of replacing desiccant pads 54, by having a user grasp finger holes 28, FIG. 4. Desiccant pads 54 can be silica gel or any other desired material. The perforations 28 also allow air to flow throughout the interior of the pillbox 20 such that air inside the pillbox can come into contact with the desiccant pads 54, FIGS. 3 and 4. The interior dimensions of the pillbox 20 are designed such that when the lid 22 is closed, the undercover 26 rests on top of the removable cups 30 to prevent the contents of the cups 30 from spilling out, FIGS. 5 and 6.

Figure 5A:
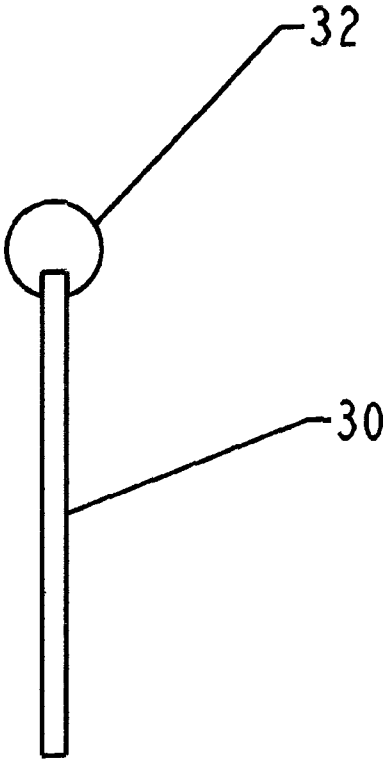
FIG. 5A is a section, enlarged, taken along 5A—5A of FIG. 5 showing the side of the removable cup.

The removable cups 30 are shaped similar to those employed by hospitals to administer medications 34, FIG. 5. Preferably, the removable cups 30 are made of a tough, flexible plastic. Each removable cup 30 is designed with a thick lip 32 to allow a user to easily grasp the cup when the cup is positioned in the pillbox so the cup may be easily retrieved therefrom. The thick lips 32 of the removable cups 30 are designed such that, when the lid 22 is closed on top of the cups 30, the medications will not fall out, but not air-tight so as to restrict air circulation throughout the pillbox, FIG. 6. The lips 32 are preferably comprised of rubberized material attached to and bonded over the top edges of the cups 30 as shown in FIG. 5A. It is contemplated that the rubberized lips 32 be at least about ⅛ inch but not greater than about ⅜ inch thick, FIGS. 5 and 5A.

Figure 7:
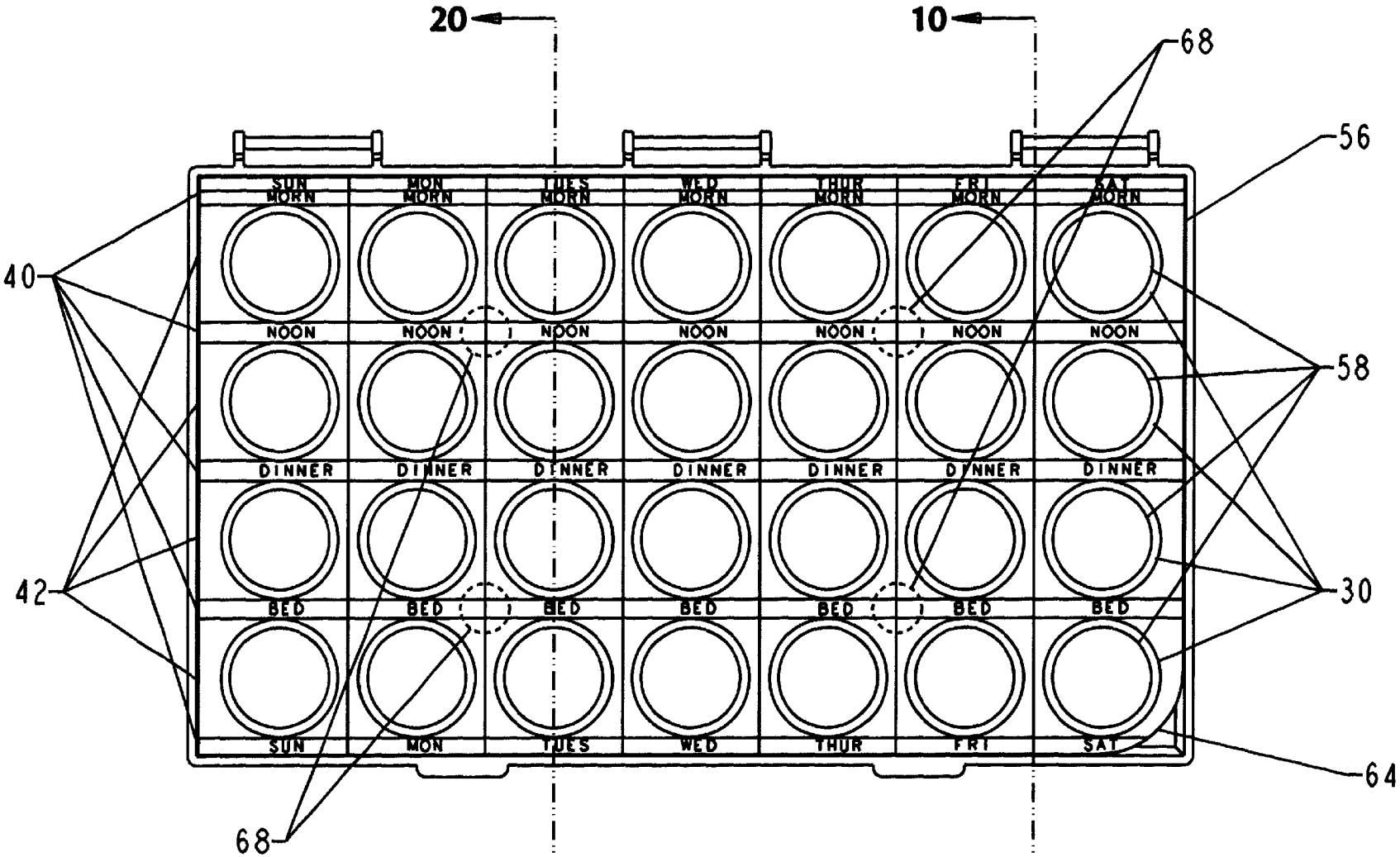
FIG. 7 is a top plan view of the first embodiment, generally, of the interior of the lower section of the pillbox showing a platform in place.
Figure 9:
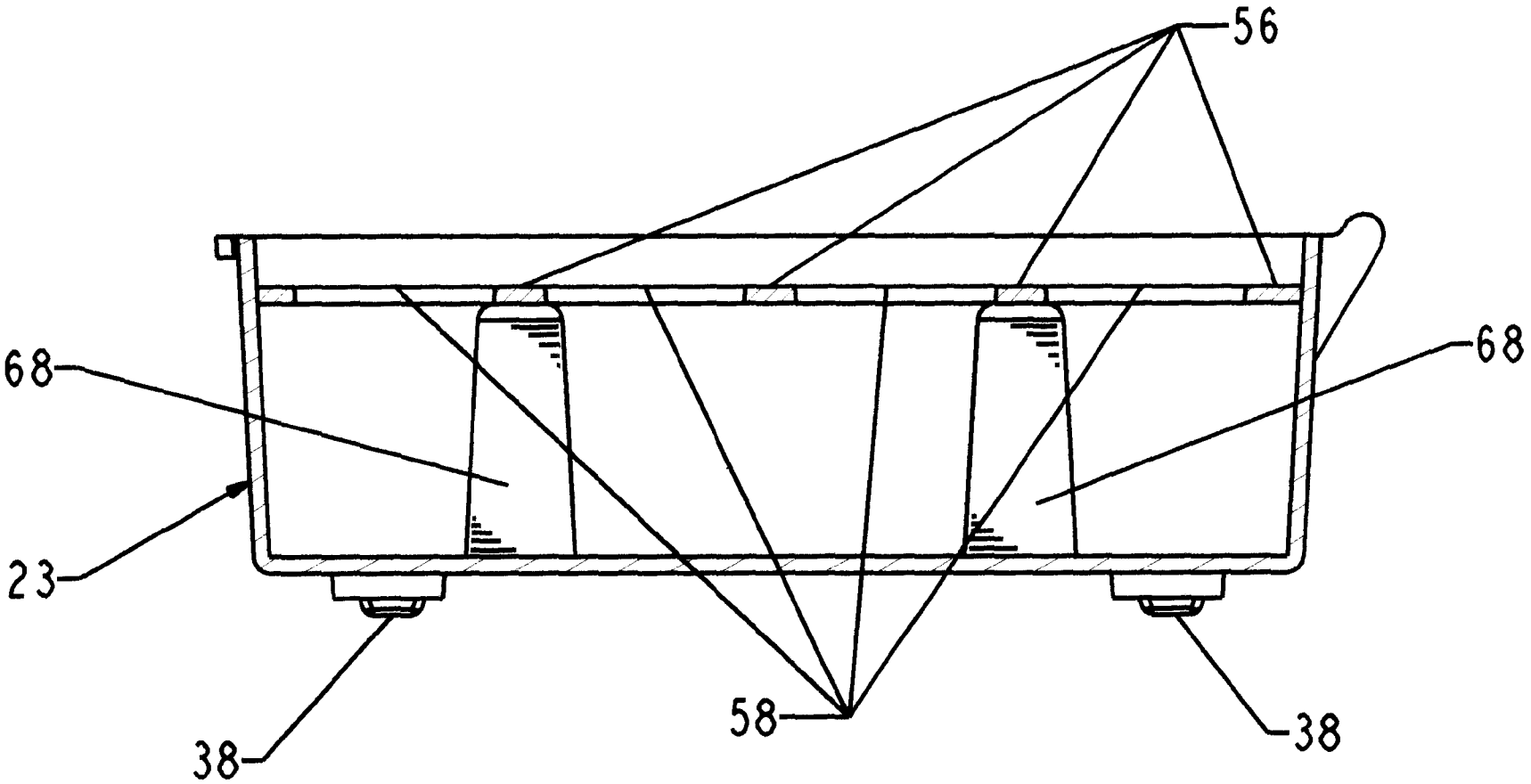
FIG. 9 is a section showing the first embodiment of the interior of the lower section taken along 9—9 of FIG. 7 with the removable cups removed.

The interior of the lower section of the pillbox 20 is constructed such that the removable cups 30 are securely held in place until they are removed to administer medications. In a first embodiment, a platform 56 is designed to be placed over the interior of the lower section of the pillbox 20 to hold the removable cups 30, FIGS. 6–9, in place. The platform 56 is also preferably a tough durable plastic material having circular cutouts 58 in which the removable cups 30 rest, as shown in FIGS. 7 and 9. The platform 56 is held in place by support posts 68, extending upwardly from the bottom of the pillbox, and the tops of the support posts 68 are ultrasonically welded or otherwise secured to the platform 56, as shown in FIGS. 6, 7, and 9. The support posts 68 are molded as part of the bottom of the pillbox. The support posts 68 can also be bonded separately to the bottom of the pillbox. A pill recovery notch 64, FIG. 7, created by having a piece cut away from the platform 56, is adapted to allow errant medications to be conveniently retrieved if such medications are accidentally dropped into the bottom of the pillbox, such as when the contents of a cup 30 are spilled.

Figure 10:
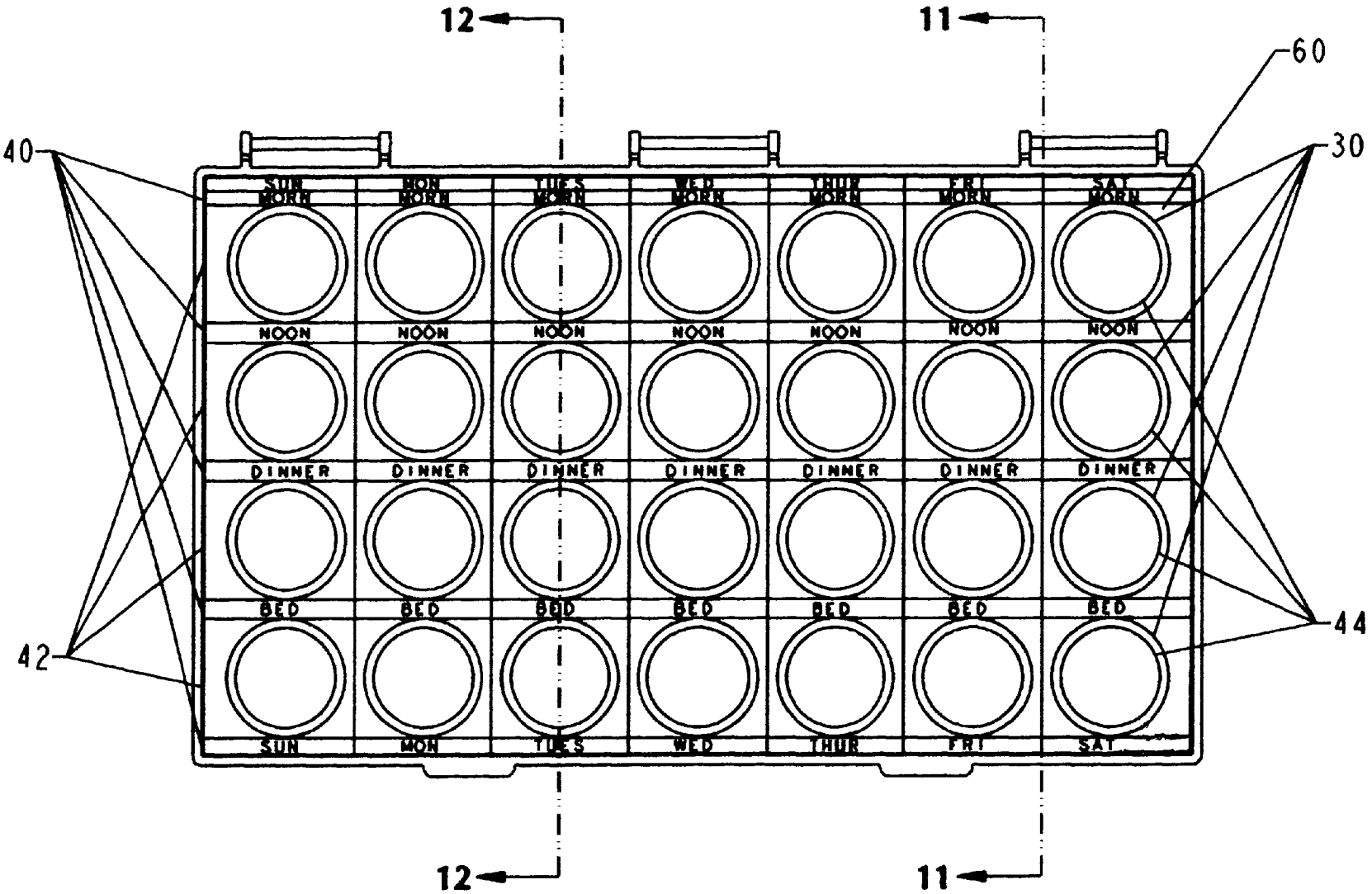
FIG. 10 is a top plan view of the second embodiment, generally, of the lower section of the pillbox.
Figure 12:
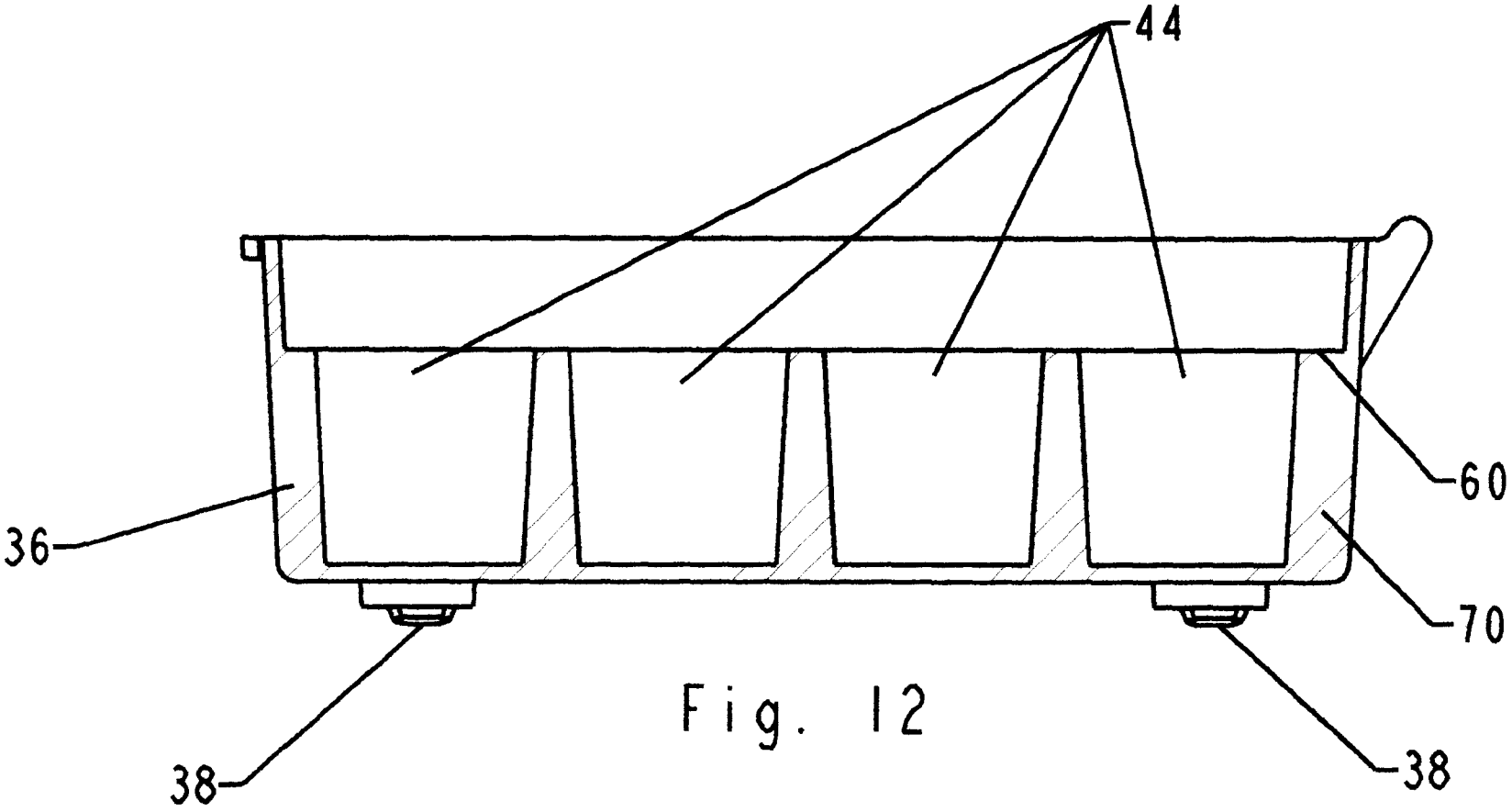
FIG. 12 is a section showing the second embodiment of the interior of the lower section of the pillbox taken along 12—12 of FIG. 10, with the removable cups removed.

In a second embodiment, FIGS. 10 and 12, the interior of the lower section of the box 20 is injected with plastic foam 70 such that the foam fills the space thereof and the foam is molded or otherwise configured to provide recesses 44 in the shape of the removable cups 30 so that the cups do not move when they are placed in the recesses 44.

The foam may be of a type that forms a surface skin on top. In such case, the surface skin of the foam forms a platform 60 and allows directions to be stamped thereon, FIG. 10. If the foam does not form a surface skin, a separate platform 60 may be bonded to the top surface of the foam or to the lower section of the box. When attached to the lower section of the box, foam may be injected into the space between the platform 60 and the bottom of the box.

In the illustrated embodiment, the pillbox 20 holds seven removable cups in four divided rows, FIGS. 7 and 10. The platform 56 is marked with indicia 40, having raised or indented letters, to indicate when medications are to be taken, FIGS. 7 and 10. In the illustrated embodiment, the top row is labeled with the days of the week and the word "Morn" (morning), the second row is labeled "Noon", the third row "Dinner", and the fourth row with "Bed". The last row is labeled with the days of the week, FIGS. 7 and 10. FIG. 7 also shows removable cups 30 fitting into circular cutouts 58 each lining up with a particular day of the week and a time of day.

Figure 11:
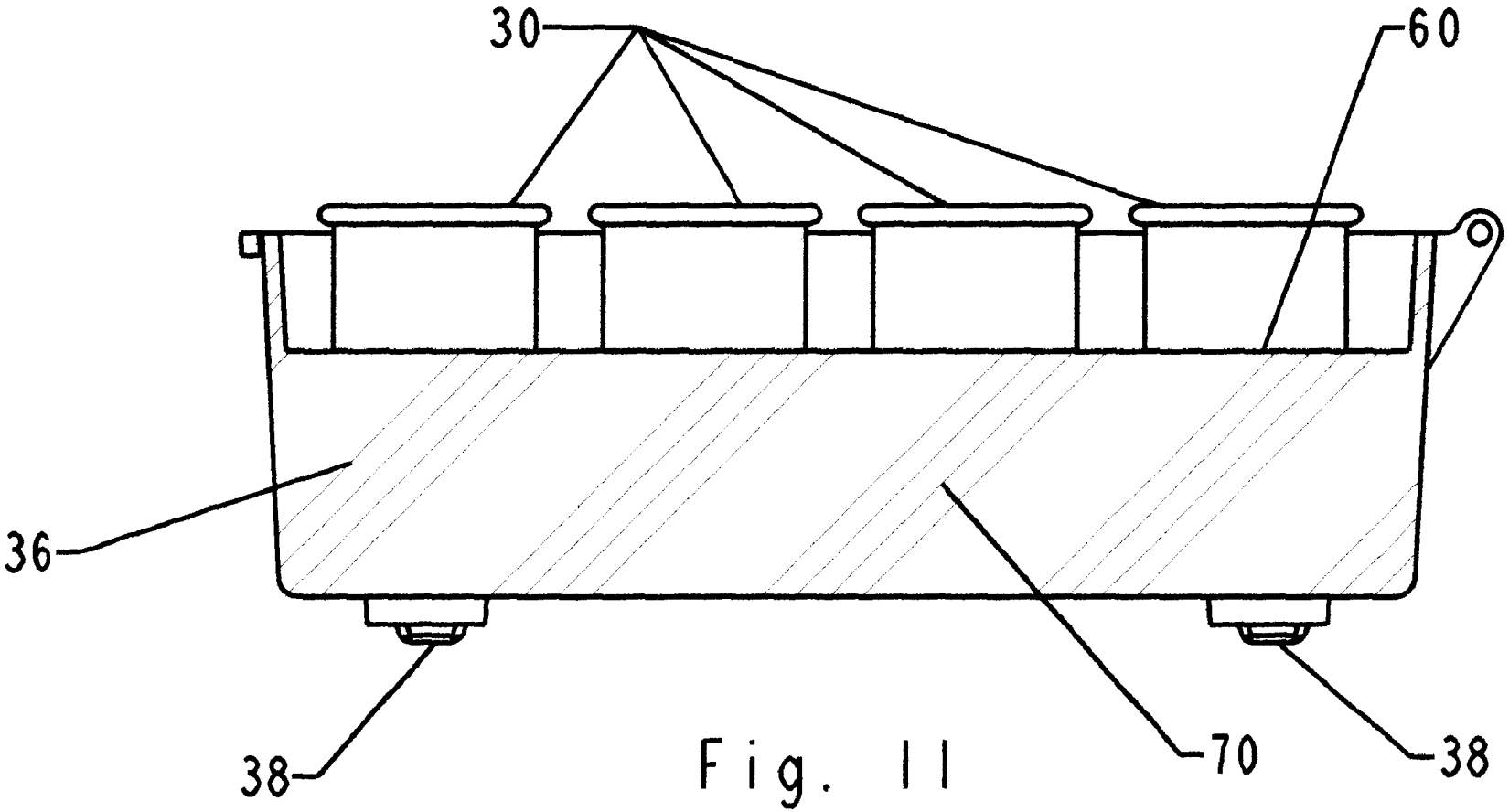
FIG. 11 is a section showing a second embodiment of the interior of the lower section of the pillbox taken along 11—11 of FIG. 10 further showing a row of removable cups.

In the second embodiment, the markings are similar to those illustrated in the first embodiment, FIG. 10. The removable cups 30 are adapted to fit into recesses 44 molded in the interior of the lower section 23, FIGS. 11 and 12.

Figure 13:
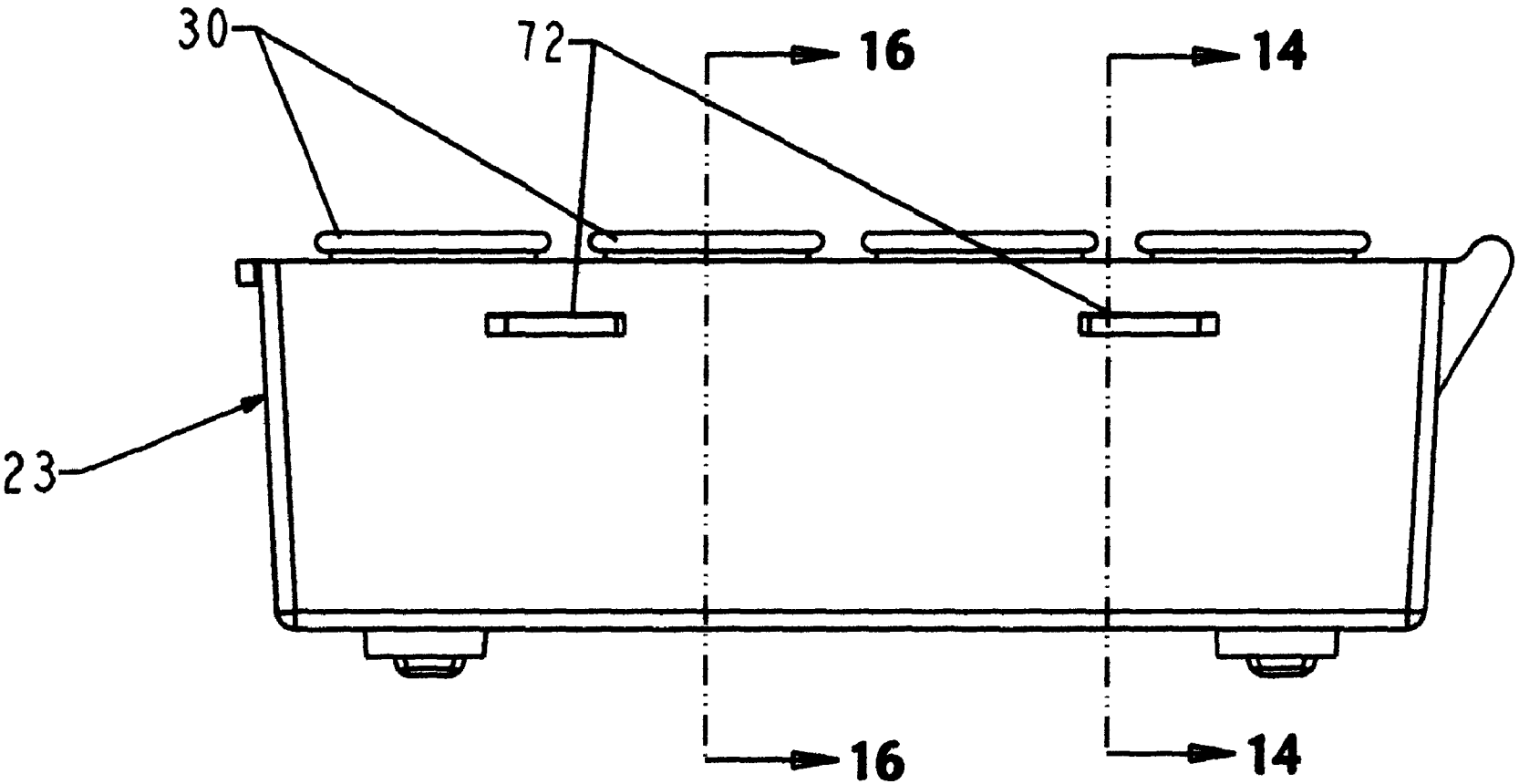
FIG. 13 is a side elevation a third embodiment, generally, of the lower section of the pillbox.
Figure 14:
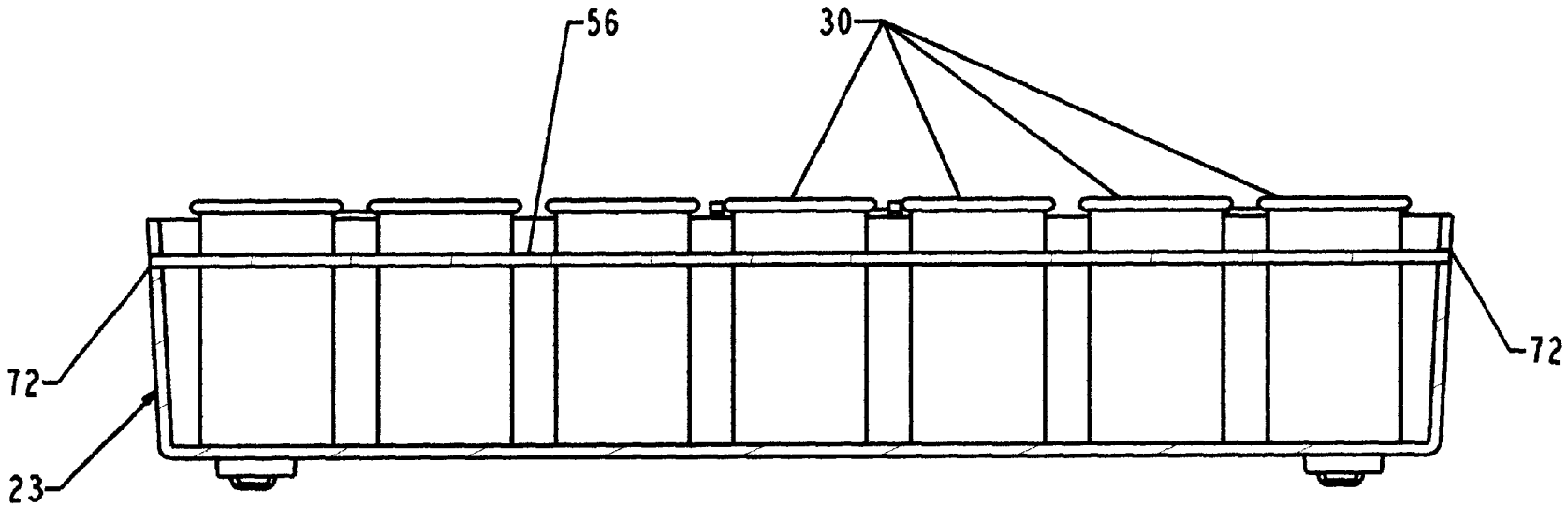
FIG. 14 is a section taken along 14—14 of FIG. 13 showing the third embodiment of the interior of the lower section of the pillbox further showing a row of removable cups.
Figure 15:
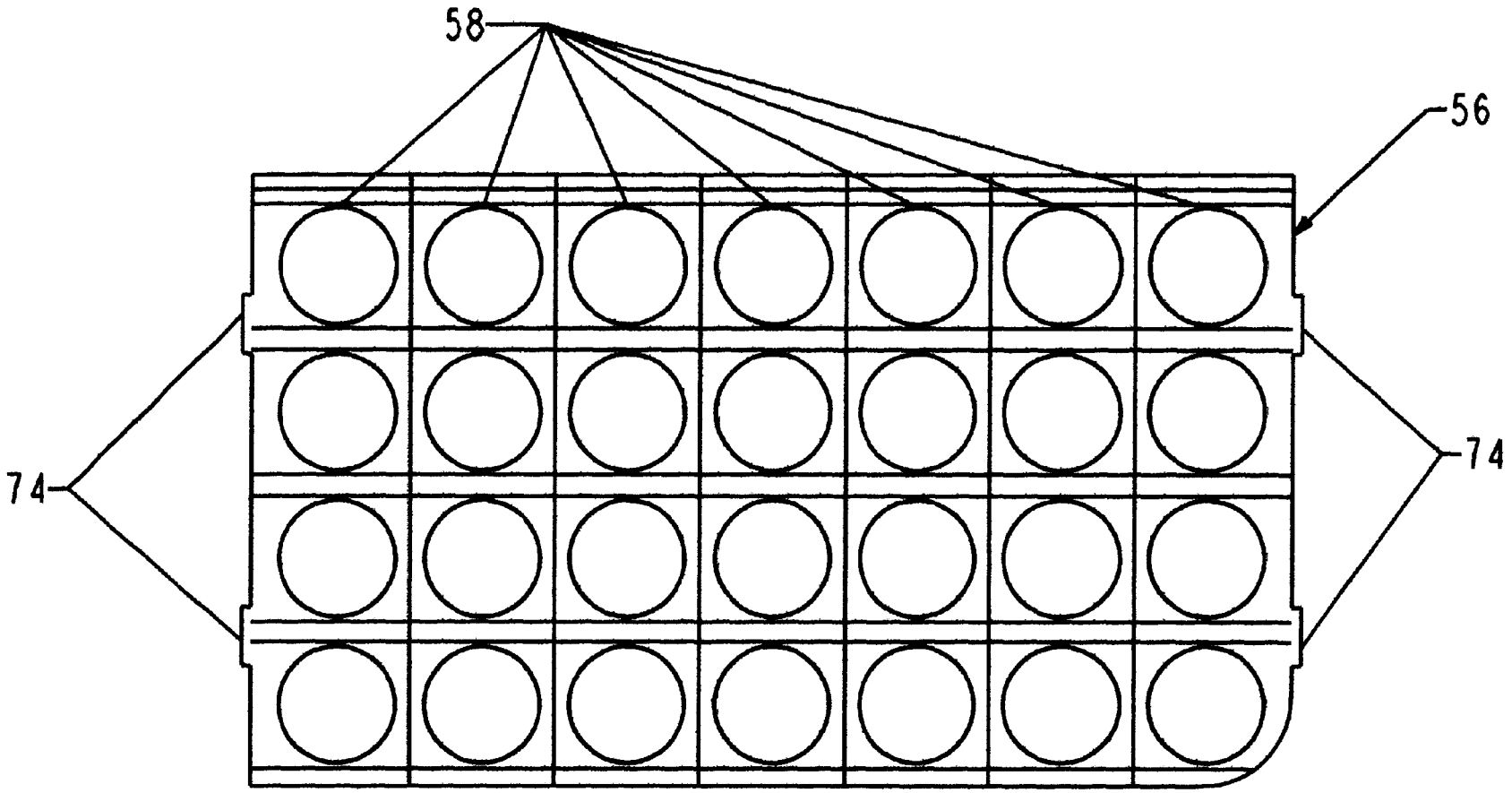
FIG. 15 is a top plan view of the third embodiment platform, generally, of the interior of the lower section of the pillbox.
Figure 16:
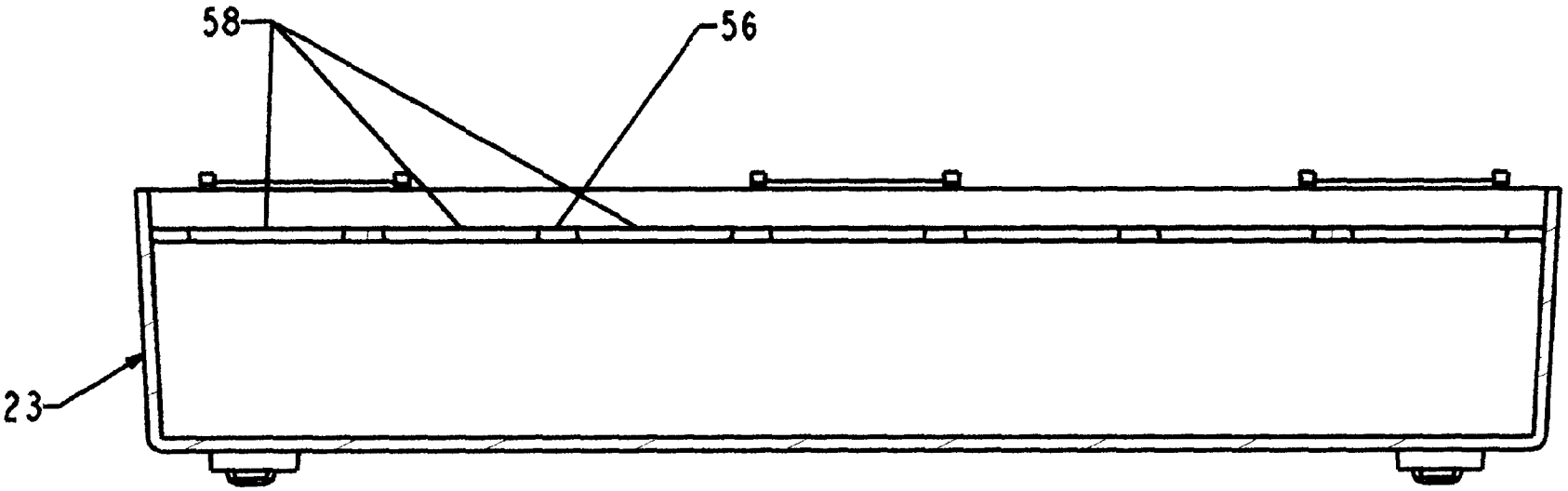
FIG. 16 is a section taken along 16—16 of FIG. 13 showing the third embodiment of the interior of the lower section of the pillbox with the removable cups removed.

In the third embodiment, the platform 56 is designed to be held in the interior of the lower section by having tabs 74, FIG. 15, which, when flexed, snap into notches 72 of the lower section 23, FIG. 13. As in the first embodiment, the platform 56 is preferably a tough plastic material having circular cutouts 74, FIGS. 15 and 16, in which the removable cups 30 are held, FIG. 14.

The Pillbox is preferably constructed of plastic. It is contemplated that the plastic be of a clear or a light translucent color. The Pillbox can be constructed of amber-tinted plastic to shield the contained medications from ultraviolet rays that can reduce the strength of medications. The amber color is created by color compounding which is a well known process in the art to tint and color plastic.

While the present invention has been disclosed in connection with the preferred embodiment thereof, it should be understood that there may be other embodiments which fall within the spirit and scope of the invention as defined by the following claims.

What is claimed is:

1. A pillbox for holding medications to be dispensed, comprising:

a box having a lid and lower section;

removable cups for holding the medications;

means for keeping the medications dry; and a platform which defines the interior of the lower section having openings adapted to hold the removable cups.

2. A pillbox for holding medications to be dispensed according to claim 1, wherein the means for keeping the medications dry comprises a means to facilitate air circulation within the box and a desiccant.

3. A pillbox for holding medications to be dispensed according to claim 2, wherein the means to facilitate air circulation within the box comprises a compartment formed by having an undercover which snaps onto the lid and adapted to contain the desiccant, said undercover having openings therein.

4. A pillbox for holding medications to be dispensed according to claim 3, wherein the undercover comes into contact with the tops of the removable cups.

5. A pillbox for holding medications to be dispensed according to claim 1, wherein the removable cups are constructed with rubberized lips at least about ⅛ inch thick forming tops of said cups.

6. A pillbox for holding medications to be dispensed according to claim 1, wherein the removable cups are constructed with rubberized lips not greater than about ⅜ inch forming tops of said cups.

7. A pillbox for holding medications to be dispensed according to claim 1, wherein the platform is supported by support posts, the support posts being formed from and part of the bottom of the pillbox and being ultrasonically welded to the platform.

8. A pillbox for holding medications to be dispensed according to claim 7, wherein a corner of the platform is cut out to form a notch through which to recover dropped medications.

9. A pillbox for holding medications to be dispensed according to claim 1, wherein the interior of the lower section is injected with plastic foam in the space between the platform and the bottom of the lower section, the plastic foam being formed with recesses adapted to coincide with the openings of the platform to hold the removable cups.

10. A pillbox for holding medications to be dispensed according to claim 9, wherein the plastic foam is polyurethane.

11. A pillbox for holding medications to be dispensed according to claim 1, wherein the platform has tabs adapted to be inserted into notches in the sides of the lower section, such that said platform can be snapped into place and be supported by the lower section.

12. A pillbox for holding medications to be dispensed according to claim 11, wherein a corner of the platform is cut out to form a notch through which to recover dropped medications.

13. A pillbox for holding medications to be dispensed according to claim 1, wherein the bottom of the lower section of the pillbox is mounted with rubber feet.

14. A pillbox for holding medications to be dispensed according to claim 1, wherein said pillbox is constructed of plastic.

15. A pillbox for holding medications to be dispensed according to claim 11, wherein the plastic is an amber color.

16. A pillbox for holding medications to be dispensed according to claim 1, wherein the platform, which hold the rows of removable cups, contains indicia describing the time when said cups are to be removed for dispensing medications.

17. A pillbox for holding medications to be dispensed according to claim 1, wherein the removable cups are arranged in four rows of seven cups.

18. A pillbox for holding medications to be dispensed, comprising:

a box having a lid and lower section;

removable cups for holding the medications;

a compartment formed by having an undercover which snaps onto the lid and adapted to contain a desiccant, said undercover having openings therein;

a desiccant; and a platform which defines the interior of the lower section having openings adapted to hold the removable cups.

* * * * *